US008397664B2

(12) United States Patent
Lin et al.

(10) Patent No.: US 8,397,664 B2
(45) Date of Patent: Mar. 19, 2013

(54) GOLF BALL COATING SYSTEM USING MAGNETIC LEVITATION

(75) Inventors: Hsiao-Chin Lin, Yun-Lin Hsien (TW); Chin-Shun Ko, Kaohsiung (TW)

(73) Assignee: NIKE, Inc., Beaverton, OR (US)

( * ) Notice: Subject to any disclaimer, the term of this patent is extended or adjusted under 35 U.S.C. 154(b) by 35 days.

(21) Appl. No.: 13/048,750

(22) Filed: Mar. 15, 2011

(65) Prior Publication Data

US 2012/0237689 A1 Sep. 20, 2012

(51) Int. Cl.
*B05B 13/02* (2006.01)

(52) U.S. Cl. ..... 118/324; 118/62; 118/300; 118/315

(58) Field of Classification Search ..... None
See application file for complete search history.

(56) References Cited

U.S. PATENT DOCUMENTS

| | | | | |
|---|---|---|---|---|
| 2,833,241 | A | 5/1958 | Crowley et al. | |
| 5,747,780 | A * | 5/1998 | Shioyama et al. | 118/719 |
| 6,436,327 | B1 | 8/2002 | Cloutier et al. | |
| 6,544,337 | B1 | 4/2003 | Skrabski et al. | |
| D498,431 | S | 11/2004 | Ditmars, Jr. | |
| 6,850,137 | B2 | 2/2005 | Bird et al. | |
| 7,682,265 | B2 | 3/2010 | VanDelden | |
| 2006/0083859 | A1 | 4/2006 | Robida | |
| 2006/0148590 | A1 * | 7/2006 | Sullivan et al. | 473/371 |
| 2007/0101933 | A1 * | 5/2007 | Chappa | 118/620 |
| 2007/0259102 | A1 * | 11/2007 | McNiven et al. | 427/2.25 |
| 2008/0315469 | A1 | 12/2008 | Hogge et al. | |
| 2009/0110837 | A1 * | 4/2009 | Wachi | 118/50 |

FOREIGN PATENT DOCUMENTS

| | | | |
|---|---|---|---|
| EP | 1437180 | A1 | 7/2004 |
| GB | 1033483 | A | 6/1966 |
| JP | 61178328 | A | 7/1986 |
| JP | 62168566 | A | 7/1987 |
| JP | 1293155 | | 11/1989 |
| JP | 1307468 | A | 12/1989 |
| JP | 2000005348 | A | 1/2000 |
| JP | 2002140116 | A | 5/2002 |
| WO | W02007130257 | A2 | 11/2007 |

OTHER PUBLICATIONS

European Search Report for European Patent Application No. EP12159443.6, mailed on Jul. 17, 2012.
Examiner's Report for Canadian Patent Application No. 2769753, mailed on Aug. 7, 2012.

* cited by examiner

*Primary Examiner* — Dah-Wei Yuan
*Assistant Examiner* — Stephen Kitt
(74) *Attorney, Agent, or Firm* — Plumsea Law Group, LLC

(57) ABSTRACT

A coating system for golf balls using magnetic levitation is described. Golf balls including magnetic material interact with a magnetic field generated by a magnetic field source with a platform. The interaction between the magnetic field and the golf ball causes the golf ball to levitate above the platform. A conveyor apparatus is used to move the golf balls and platforms through the coating system. The levitating golf balls are sprayed with coating material. Spraying the levitating golf balls allows for even and uniform coating of the golf ball. Additionally, imparting a spin or rotation to the golf balls assists with the even and uniform application of the sprayed coating material.

20 Claims, 8 Drawing Sheets

GOLF BALL COATING SYSTEM USING MAGNETIC LEVITATION

BACKGROUND

The present invention relates generally to a coating system for a golf ball, and, in particular, to a coating system for a golf ball using magnetic levitation.

In a conventional coating system for golf balls, typically a three-prong or four-prong device is used to hold golf balls in place for coating. For example, U.S. Pat. No. 6,544,337 teaches a golf ball painting system where the golf balls are supported by prongs on spindles as the golf balls move through the system on a conveyor.

In some cases, the tips of prongs can be sharp, and the sharp tips can scratch the coated golf ball surface and/or stab into the golf ball cover and make small holes. In other cases, the prongs may prevent the spray from completely and evenly coating the golf ball. In such cases, scratch marks, holes, and/or uneven coating can affect the aesthetic appearance and/or dynamic performance characteristics of the golf ball.

Therefore, there exists a need in the art for a coating system for golf balls that can provide a more uniform and even coating, and, also, that does not leave marks in the coating from prongs used to hold the golf ball in place during the coating process.

SUMMARY

In one aspect, the invention provides a coating system for coating a golf ball comprising: a conveyor apparatus for transporting a carrier; a platform associated with the carrier, the platform including a magnetic field source; a spraying unit for spraying a coating material onto the golf ball; and wherein the magnetic field source generates a magnetic field that interacts with magnetic material disposed within the golf ball to levitate the golf ball above the platform.

In another aspect, the invention provides a method for coating a golf ball using magnetic levitation, the method comprising the steps of: introducing a golf ball into a coating system, the golf ball including a magnetic material; placing the golf ball onto a platform, the platform including a magnetic field source; levitating the golf ball above the platform by generating a magnetic field using the magnetic field source; and spraying a coating material onto the golf ball.

In another aspect, the invention provides a coating system for coating a golf ball comprising: at least one golf ball containing magnetic material; a conveyor apparatus for transporting a carrier including at least one platform; the platform including a magnetic field source for generating a magnetic field and configured to transport the at least one golf ball; a spraying unit for spraying a coating material onto the at least one golf ball; and wherein the at least one golf ball containing magnetic material levitates above the platform when the magnetic field source is generating the magnetic field.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a coating system for golf balls using magnetic levitation. Specifically, in some embodiments, golf balls may include magnetic material for interacting with a magnetic field generated by a platform. The interaction between the magnetic field and the golf ball levitates the golf ball and may allow for even and uniform coating of the golf ball. For purposes of illustration, the golf balls shown in the Figures may be depicted with smooth covers. The embodiments shown in the Figures and described in the various embodiments herein may include dimples, including dimple types, configurations, and/or arrangements as is known in the art.

Figure 1:
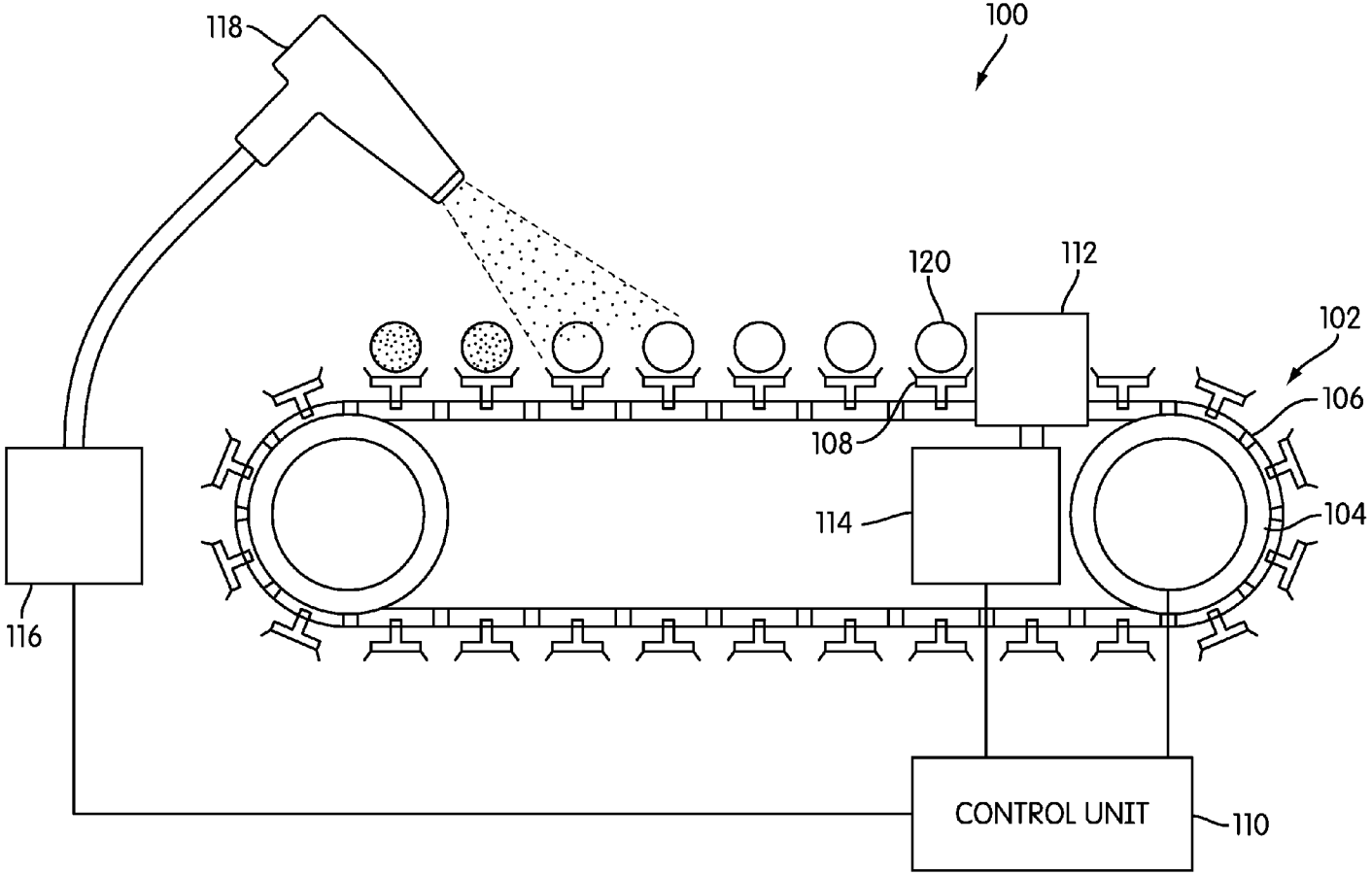
FIG. 1 is a schematic view of an exemplary embodiment of a coating system for golf balls using magnetic levitation.

FIG. 1 is an exemplary embodiment of a coating system 100 for golf balls using magnetic levitation. In some embodiments, coating system 100 may include one or more components for transporting a golf ball between various stations associated with coating system 100. In one embodiment, coating system 100 may include a conveyor apparatus 102. Conveyor apparatus 102 may be configured to transport a golf ball within coating system 100. In some embodiments, conveyor apparatus 102 may include components typically associated with a conveyor system, including, but not limited to: a carrier platform, a drive system, and controls.

In one embodiment, conveyor apparatus 102 may include a drive system 104. Drive system 104 may provide locomotive power to conveyor apparatus 102 to transport one or more golf balls within coating system 100. In this embodiment, drive system 104 may include one or more rollers for providing locomotive power to conveyor apparatus 102. In some embodiments, conveyor apparatus 102 may further include a carrier 106. Carrier 106 may be configured to move along conveyor apparatus 102. In one embodiment, carrier 106 may be moved by drive system 104. In some cases, carrier 106 may include a belt. In other cases, carrier 106 may include a chain or pendant arrangement.

In some embodiments, conveyor apparatus 102 may include one or more platforms that are configured to hold a golf ball for transport within coating system 100. In one embodiment, a plurality of platforms 108 may be associated with carrier 106. In an exemplary embodiment, each platform 108 may hold a single golf ball 120. In other embodiments, multiple platforms may be grouped together to hold multiple golf balls. In an exemplary embodiment, platform 108 may be a magnetic levitation platform, as described in more detail below.

Coating system 100 may include one or more provisions that are configured to control various operations associated with coating system 100. In one embodiment, coating system 100 may include a control unit 110. In some embodiments, control unit 110 may be configured to control one or more stations associated with coating system 100. In an exemplary embodiment, control unit 110 may control operations associated with conveyor apparatus 102, including drive system 104, carrier 106, and/or platform 108, as well as other components associated with conveyor apparatus 102 and coating system 100. In some embodiments, control unit 110 may include one or more processors or computers configured to generate and execute commands. In addition, in other embodiments, control unit 110 may include input devices for receiving commands from a user. In various embodiments, control unit 110 may include different modes of operation, including automatic, manual, or automatic and manual operation.

In some embodiments, control unit 110 may be further configured to control additional operations associated with coating system 100. In an exemplary embodiment, control unit 110 may control operations associated with mechanisms for spinning golf balls. In one embodiment, coating system 100 may include a mechanism for spinning the golf balls on conveyor apparatus 102. By spinning the golf balls, the coating material may be applied in a more even and uniform manner. In this embodiment, the mechanism for spinning the golf balls is an air blowing system, including a blower unit 112 that may channel air provided from an air pump 114. In other embodiments, different mechanisms may be provided for spinning the golf balls on platforms 108.

Control unit 110 may also be configured to control operations associated with a mechanism for spraying coating material onto the golf balls. In an exemplary embodiment, coating system 100 may include a spraying unit 118 that that may spray one or more coating materials onto a golf ball using an air pump 116. It should be understood that spraying unit 118 may include additional components associated with a spraying unit that are not illustrated in FIG. 1, including, but not limited to tanks or other supply feeds for introducing the coating materials into spraying unit 118. In various embodiments, spraying unit 118 may be provided for coating golf balls with one or more paint layers, basecoats or primers, and/or topcoats, as well as spraying or coating any other material onto a golf ball.

In one embodiment, control unit 110 may control operations associated with multiple stations or mechanisms within coating system 100. In this embodiment, control unit 110 may be configured to control operations of conveyor apparatus 102, including drive system 104, carrier 106, and/or platform 108, a spinning station, including blower unit 112 and air pump 114, and a spraying station, including spraying unit 118 and air pump 116. In other embodiments, control unit 110 may be configured to control additional components of coating system 100. In some embodiments, multiple control units may be provided for controlling various stations and/or mechanisms within coating system 100.

Figure 2:
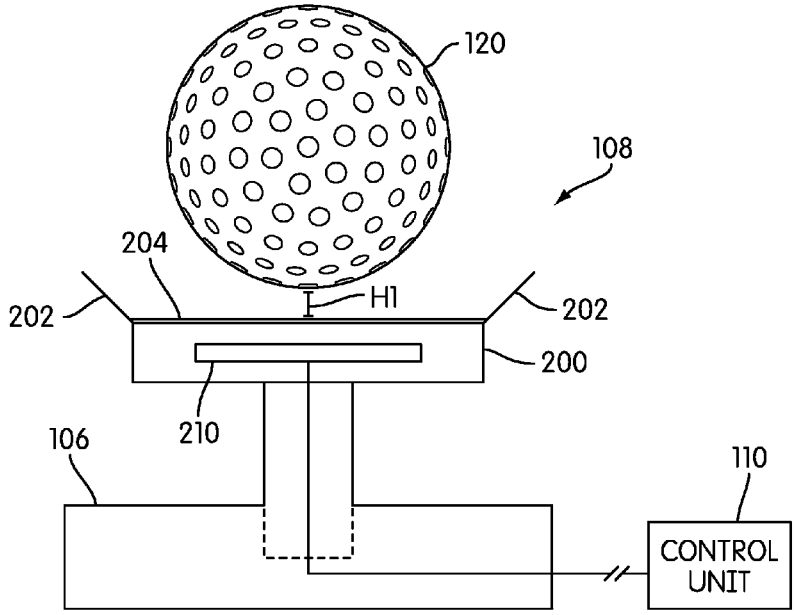
FIG. 2 is a schematic view of an exemplary embodiment of a magnetic levitation platform.

Referring now to FIG. 2, an exemplary embodiment of platform 108 that may be used with coating system 100 is illustrated. In an exemplary embodiment, platform 108 may be a magnetic levitation platform. In this embodiment, magnetic levitation platform 108 may generate a magnetic field that interacts with magnetic material in golf ball 120. With this arrangement, the interaction between the magnetic field and golf ball 120 causes golf ball 120 to levitate a height H1 above magnetic levitation platform 108. Levitation of golf ball 120 allows contactless spraying of golf ball 120 to provide a more even and uniform coating.

In an exemplary embodiment, a base portion 200 of platform 108 may include a magnetic field source 210. Magnetic field source 210 may be provided to generate the magnetic field that interacts with the magnetic material in golf ball 120. In one embodiment, magnetic field source 210 may be an electromagnetic coil. In other embodiments, magnetic field source may be any apparatus capable of generating a magnetic field. It should be understood that magnetic field source 210 may be supplied with power from a power source that is not illustrated. In some embodiments, magnetic field source 210 may be controlled by control unit 110. In an exemplary embodiment, the strength of the magnetic field generated by magnetic field source 210 may be changed by supplying different amounts of current to magnetic field source 210. With this arrangement, the height of golf ball 120 above base portion 200 of platform 108 may be varied. In this embodiment, golf ball 120 is shown height H1 above base portion 200. By changing the current supplied to magnetic field source 210, height H1 may be increased or decreased.

In some embodiments, magnetic field source 210 may be controlled so that height H1 of golf ball 120 above base portion 200 of platform 108 may be configured to provide sufficient clearance for spraying coating material onto golf ball 120. In some embodiments, height H1 may provide from 1 cm to 10 cm of clearance between the bottom of golf ball 120 and the top surface of base portion 200 of platform 108. In an exemplary embodiment, height H1 may be from 2 cm to 8 cm. In one embodiment, height H1 may be from 2 cm to 6 cm. In other embodiments, magnetic field source 210 may be controlled to provide different amounts of clearance between bottom of golf ball 120 and the top surface of base portion 200 of platform 108. In addition, in some embodiments, height H1 may be varied based on the location of golf ball 120 within coating system 100. In an exemplary embodiment, height H1 may be increased prior to entering a spraying station associated with coating system 100 to provide sufficient clearance for spraying the coating material onto the golf ball. In other embodiments, height H1 may be substantially constant throughout coating system 100.

In some embodiments, platform 108 may include one or more components configured to hold golf ball 120 in place while moving through coating system 100 on carrier 106. In this embodiment, platform 108 includes base portion 200 and lip 202. Lip 202 may be disposed around the perimeter of base portion 200 to provide a barrier for golf ball 120. With this arrangement, golf ball 120 may be prevented from moving off base portion 200.

In some embodiments, the top surface of base portion 200 may include one or more layers of film 204. Film 204 may be removable thin layers of plastic or other polymer material that catch overspray from the coating process. In some embodiments, film 204 may be removed from base portion 200 when coating material builds up on the top surface. By removing one or more layers of film 204, the coating material buildup may be prevented from interfering with the interaction of magnetic field source 210 with golf ball 120. In other embodiments, coating system 100 may be configured to increase the strength of the magnetic field generated by magnetic field source 210 in response to build up of coating material on base portion 200.

Figure 3:
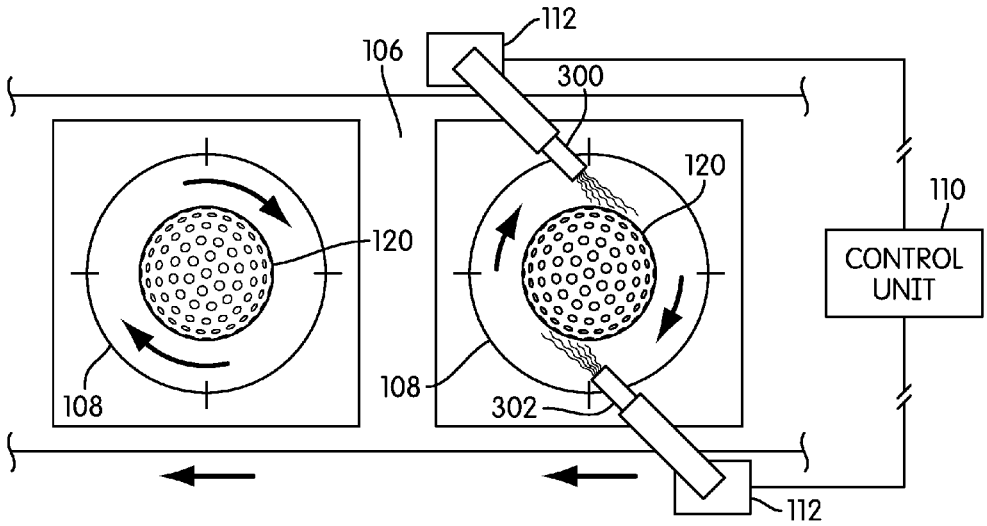
FIG. 3 is a schematic view of an exemplary embodiment of a spinning station in a coating system for golf balls.

FIG. 3 illustrates a top view of a spinning station associated with coating system 100. In some embodiments, the spinning station may be provided with one or more mechanisms for imparting a spin or rotation to golf ball 120 levitating above platform 108. In an exemplary embodiment, the spinning station is arranged within coating system 100 before the golf balls enter one or more spraying stations. With this arrangement, the spinning station imparts a rotation to the golf balls that may aid in applying an even and uniform coating onto the golf balls.

In this embodiment, the spinning station is an air blowing system, including one or more blower units 112. In some embodiments, blower unit 112 may be supplied air from air pump 114, as shown in FIG. 1. In an exemplary embodiment, each blower unit 112 may be associated with a respective air pump 114. In other embodiments, each blower unit 112 may be supplied air from a single air pump 114. Each blower unit 112 may be associated with an air nozzle for channeling the air supplied from air pump 114. In this embodiment, a first air nozzle 300 is associated with one blower unit 112 and a second air nozzle 302 is associated with another blower unit 112. In an exemplary embodiment, first air nozzle 300 and/or second air nozzle 302 may be configured to channel air towards the outside edge or periphery of golf ball 120. Interaction with the dimples on the surface of golf ball 120 generates friction with the air from first air nozzle 300 and/or second air nozzle 302 thereby imparting a spin or rotation to golf ball 120.

In this embodiment, the spinning station includes two blower units 112 arranged on opposite sides of carrier 106. With this arrangement, the force of the air blown onto golf ball 120 from first air nozzle 300 and second air nozzle 302 to impart spin to golf ball 120 may be balanced on either side. As a result, golf ball 120 may stay in place on magnetic levitation platform 108. In an exemplary embodiment, components of the spinning station may be controlled by control unit 110. In one embodiment, control unit 110 may control the process of blowing air through first air nozzle 300 and/or second air nozzle 302, including controlling the strength and/or duration of the blown air.

In other embodiments, blower units 112 and/or air nozzles may have other arrangements configured to impart spin or rotation to golf ball 120 levitating on magnetic levitation platform 108 moving along carrier 106. In still other embodiments, other mechanisms may be provided to impart spin or rotation to golf ball 120. In an alternate embodiment, more fully described in reference to FIG. 13 below, magnetic material in the golf ball 120 may be arranged in a geometrically asymmetric manner such that application of the magnetic field by magnetic field source 210 may impart a rotation to golf ball 120. In still other embodiments, any known method of imparting spin to golf balls may be used. In addition, in some embodiments, coating system 100 need not include a spinning station and the golf balls may move along carrier 106 without spinning or rotating.

Figure 4:
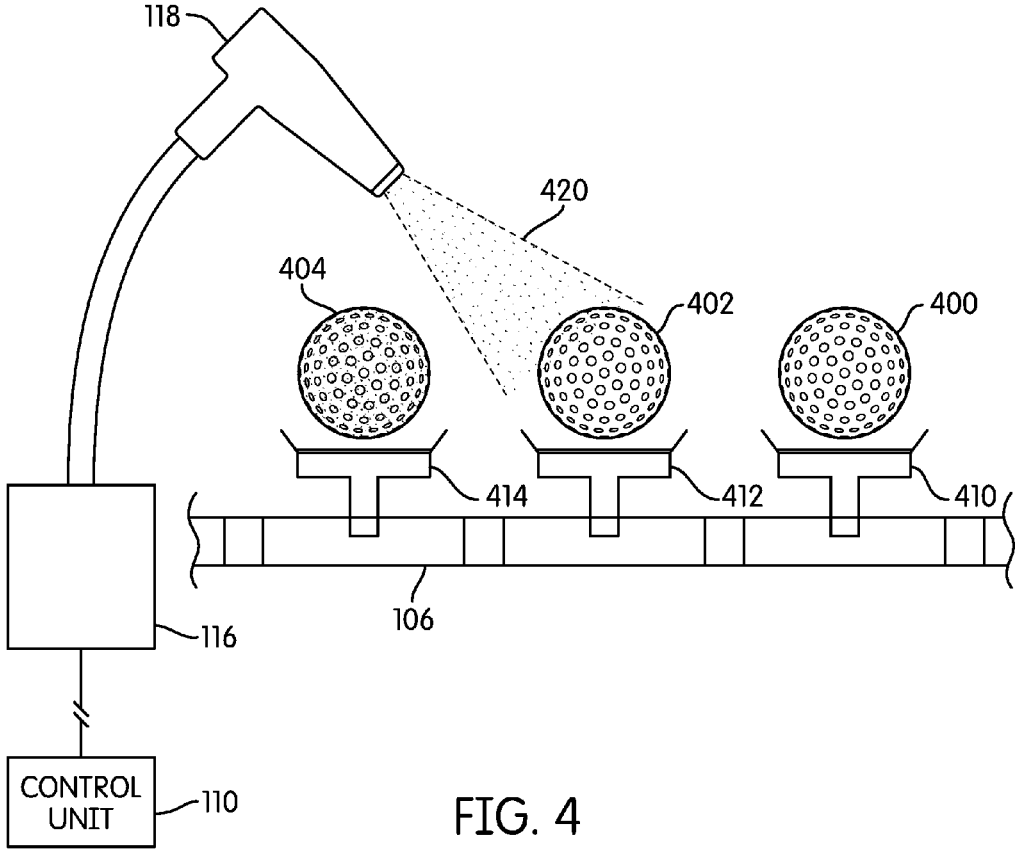
FIG. 4 is a schematic view of an exemplary embodiment of a spraying station in a coating system for golf balls.

Referring now to FIG. 4, a schematic view of an exemplary embodiment of a spraying station is illustrated. In some embodiments, coating system 100 may include one or more spraying stations for spraying paint layers, topcoats, and/or basecoats or primers, as well as any other coating material onto the golf balls. In an exemplary embodiment, the spraying station may include spraying unit 118 that that may spray one or more coating materials onto golf balls using air pump 116. It should be understood that the spraying station may include additional spraying units and may further include additional components associated with spraying units that are not illustrated, including, but not limited to tanks or other supply feeds for introducing the coating materials into spraying unit 118.

In one embodiment, golf balls move along carrier 106 on platforms towards the spraying station for coating. In the embodiment shown in FIG. 4, a first golf ball 400, a second golf ball 402, and a third golf ball 404 are being transported along carrier 106 on, respectively, a first platform 410, a second platform 412, and a third platform 414. In an exemplary embodiment, each of first golf ball 400, second golf ball 402, and/or third golf ball 404 may include magnetic material to interact with a generated magnetic field. In addition, each of first platform 410, second platform 412, and/or third platform 414 may be magnetic levitation platforms, including a magnetic field source for generating a magnetic field. In one embodiment, first platform 410, second platform 412, and/or third platform 414 may be substantially similar to magnetic levitation platform 108 and may include a magnetic field source substantially similar to magnetic field source 210, described above.

As shown in FIG. 4, in this embodiment, one or more golf balls move along carrier 106 towards spraying unit 118. In an exemplary embodiment, spraying unit 118 and/or air pump 116 may be controlled by control unit 110 to generate a coating spray 420. In some embodiments, coating spray 420 may be a fan-shaped spray of the coating material that exits spraying unit 118 through a nozzle. In this embodiment, third golf ball 404 has already passed through coating spray 420 and has a layer of coating material disposed on the outer surface. Second golf ball 402 is shown disposed within coating spray 420 in the process of being coated, while first golf ball 400 has not yet passed through coating spray 420 and is uncoated.

In some embodiments, coating system 100 may include more than one spraying station. In one embodiment, each spraying station may apply a layer of paint, topcoat, and/or basecoat or primer. In addition, in other embodiments, additional materials may be sprayed onto the golf balls, either alone or mixed with one or more of paint, topcoat, and/or basecoat or primer. In some cases, additional materials may include, but are not limited to: solvent, curing agents, drying agents, hardening agents, light reflective materials, as well as any other materials. In the embodiment shown in FIG. 4, a single spraying unit 118 may be associated with the spraying station. In other embodiments, more than one spraying unit may be included in a spraying station.

Figure 5:
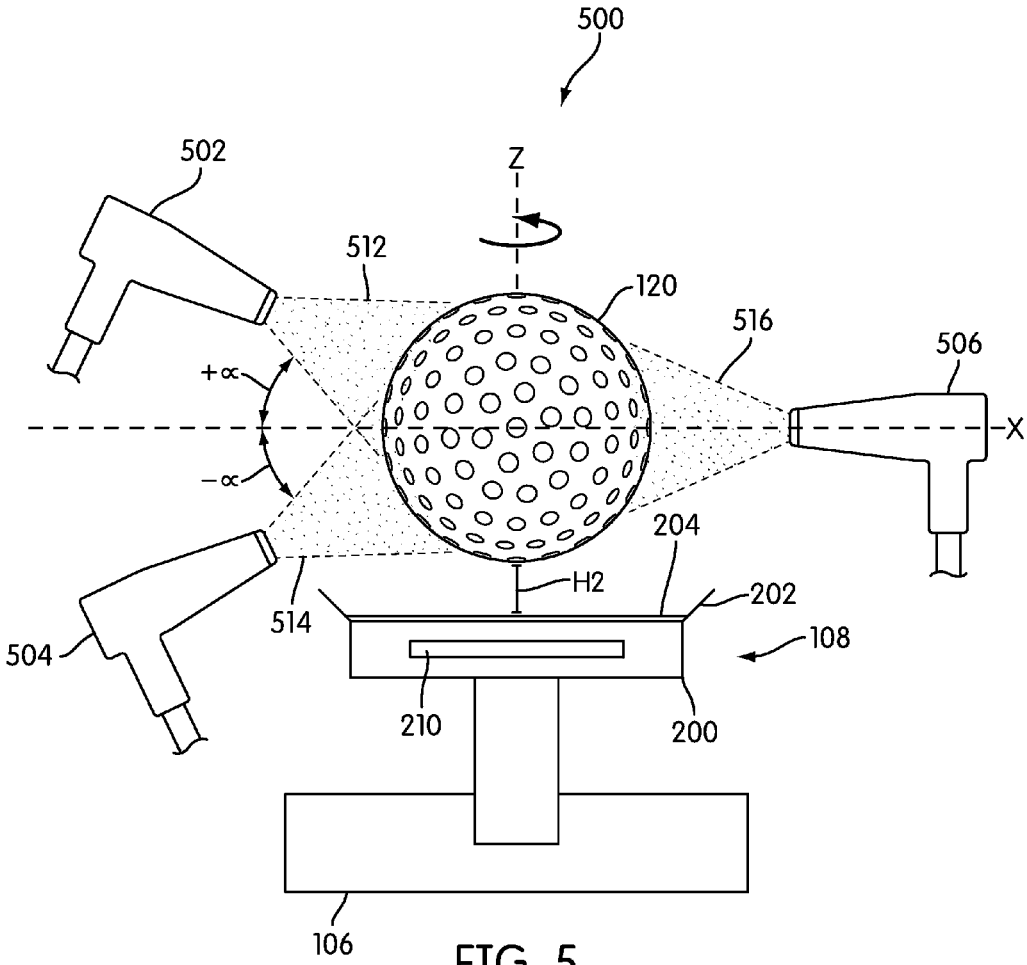
FIG. 5 is a schematic view of an alternate embodiment of a spraying station in a coating system for golf balls.

FIG. 5 illustrates an alternate embodiment of a spraying station 500 including multiple spraying units. In this embodiment, spraying station 500 may include a first spraying unit 502, a second spraying unit 504, and/or a third spraying unit 506. In some embodiments, the individual spraying units associated with spraying station 500 may be arranged to spray golf ball 120 with coating material from multiple angles and/or sides. In one embodiment, spraying units may be arranged on either side of golf ball 120. In this embodiment, first spraying unit 502 and/or second spraying unit 504 may be arranged on a first side of golf ball 120. Third spraying unit 506 may be arranged on a second side of golf ball 120, opposite first spraying unit 502 and/or second spraying unit 504 on first side of golf ball 120.

In some embodiments, spraying units also may be arranged at different angles with respect to golf ball 120. In this embodiment, third spraying unit 506 is shown oriented approximately even with golf ball 120 along the x-axis. In an exemplary embodiment, one or more spraying units may be oriented at angles above and/or below golf ball 120. In this embodiment, first spraying unit 502 may be oriented at a first angle $+\alpha$ above the x-axis. Similarly, second spraying unit 504 may be oriented at a second angle $-\alpha$ below the x-axis. In some embodiments, first angle and second angle may be substantially similar. In other embodiments, first angle and second angle may be different.

In some embodiments, the arrangement of multiple spraying units associated with spraying station 500 may be configured to balance or counteract forces associated with each spraying unit. In an exemplary embodiment, first spraying unit 502 and/or second spraying unit 504 may be arranged opposite third spraying unit 506 to balance or counteract forces associated with spraying coating material onto golf ball 120 along the x-axis. Similarly, first spraying unit 502, second spraying unit 504, and/or third spraying unit 506 may be oriented at angles above, below, and/or along the x-axis to balance or counteract forces associated with spraying coating material onto golf ball 120. Similarly, in other embodiments, spraying units may be arranged or oriented at angles with respect to any other axes, including the y-axis and/or z-axis. With this arrangement, the forces from the multiple spraying units may be balanced or counteracted to keep golf ball 120 in place rotating above magnetic levitation platform 108.

In some embodiments, the arrangement of multiple spraying units associated with spraying station 500 may be configured to provide an even or uniform coating onto golf ball 120. As shown in FIG. 5, multiple spraying units, including first spraying unit 502, second spraying unit 504, and/or third spraying unit 506, may be arranged on opposite sides and/or oriented at different angles relative to the x-axis to provide an even or uniform coating onto golf ball 120. In this embodiment, first spraying unit 502 may be associated with a first coating spray 512. Similarly, second spraying unit 504 may be associated with a second coating spray 514 and third spraying unit 506 may be associated with a third coating spray 516. In an exemplary embodiment, first coating spray 512, second coating spray 514, and/or third coating spray 516 may be a fan-shaped spray of coating material. In this embodiment, first coating spray 512, second coating spray 514, and/or third coating spray 516 are similar in shape and dimension. In other embodiments, each coating spray may have different shapes and dimensions. With this arrangement, the coating sprays from the multiple spraying units may provide even or uniform coverage over the surface of golf ball 120.

In some embodiments, magnetic field source 210 may be controlled to change the distance of golf ball 120 above base portion 200 of platform 108. In an exemplary embodiment, the bottom surface of golf ball 120 may be a height H2 above the top surface of base portion 200 of platform 108. In one embodiment, height H2 may be a distance configured to provide sufficient clearance for spraying coating material onto golf ball 120. In some embodiments, height H2 may provide from 1 cm to 10 cm of clearance between the bottom of golf ball 120 and the top surface of base portion 200 of platform 108. In an exemplary embodiment, height H2 may be from 2 cm to 8 cm. In one embodiment, height H2 may be from 2 cm to 6 cm.

In other embodiments, magnetic field source 210 may be controlled to provide different amounts of clearance between bottom of golf ball 120 and the top surface of base portion 200 of platform 108. In addition, in some embodiments, the height may be varied based on the location of golf ball 120 within coating system 100. In one embodiment, the height may be increased prior to entering and/or within a spraying station associated with coating system 100 to provide sufficient clearance for spraying the coating material onto the golf ball. In an exemplary embodiment, golf ball 120 may be a first height above the top surface of base portion 200 of platform 108 prior to entering spraying station 500. For example, golf ball 120 may be associated with a clearance of height H1, as shown in FIG. 2. As golf ball 120 enters spraying station 500, magnetic field source 210 may be controlled to increase the clearance of golf ball 120. In an exemplary embodiment, golf ball 120 may be a second height above the top surface of base portion 200 of platform 108 within spraying station 500. For example, golf ball 120 may be associated with a clearance of height H2, as shown in FIG. 5.

In some embodiments, the second height may be larger than the first height. With this arrangement, the height may be increased to provide the necessary clearance for spraying coating material onto golf ball 120. In other embodiments, the height may be substantially constant throughout coating system 100.

Figure 6:
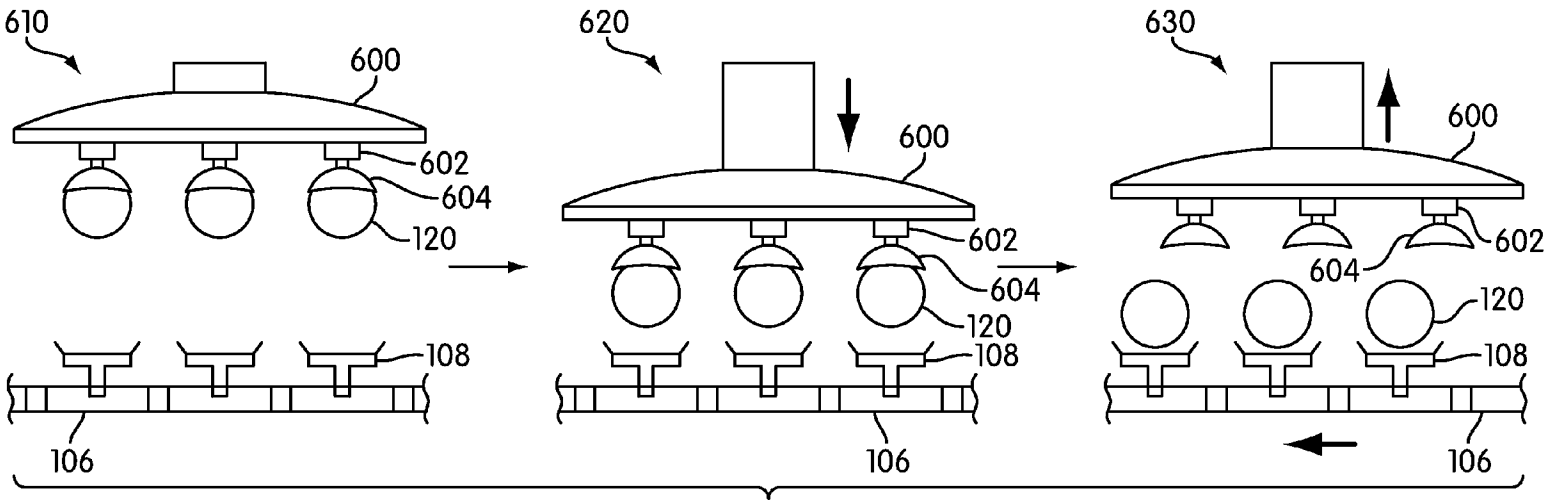
FIG. 6 is a schematic view of an exemplary embodiment of an apparatus for introducing golf balls into a coating system.

In some embodiments, coating system 100 may be provided with one or more mechanisms for introducing golf balls into coating system 100 and/or removing coated golf balls from coating system 100. In some embodiments, the introduction and/or removal of golf balls to and/or from coating system may be controlled using a control unit. In an exemplary embodiment, control unit 110 may be used. In other embodiments, separate control units may be used. FIG. 6 illustrates an exemplary embodiment of an apparatus 600 for introducing golf balls into coating system 100. In some embodiments, apparatus 600 may be configured to introduce uncoated golf balls into coating system 100 by placing the golf balls onto individual platforms 108 on carrier 106. In one embodiment, apparatus 600 may include a plurality of holding units 602. Each of the holding units 602 may be configured to move golf ball 120 into coating system 100. In an exemplary embodiment, apparatus 600 may include a suction mechanism (not shown) that generates negative pressure allowing holding units 602 to hold golf ball 120. In an exemplary embodiment, holding units 602 may include a cup 604. Cup 604 may be configured to substantially correspond to the shape of golf ball 120. In one embodiment, cup 604 may be produced from rubber, silicone, or any other flexible material that provides a seal between holding unit 602 and golf ball 120. With this arrangement, cup 604 may allow the negative pressure from the suction mechanism to hold golf ball 120 in place.

The introduction of golf balls into coating system 100 using apparatus 600 may be described with reference to FIG. 6. In a first stage 610, apparatus 600 may be loaded with a plurality of uncoated golf balls 120. In an exemplary embodiment, golf balls 120 may include magnetic material for interacting with the magnetic field generated by magnetic field sources within platforms 108. As described above, golf balls 120 may be held in place by holding units 602 using a suction mechanism (not shown) that generates negative pressure and forms a seal between cup 604 and the surface of golf balls 120. In first stage 610, apparatus 600 moves uncoated golf balls 120 from a loading station, where golf balls 120 are retrieved by apparatus 600, to carrier 106 of conveyor apparatus 102. Carrier 106 may include a plurality of magnetic levitation platforms 108 for transporting each golf ball 120 within coating system 100.

In a second stage 620, an arm associated with apparatus 600 lowers apparatus 600 towards carrier 106. In this embodiment, each holding unit 620 holding respective golf ball 120 may be aligned over a corresponding magnetic levitation platform 108 on carrier 106. Once apparatus 600 has aligned holding units 602 with magnetic levitation platforms 108, the arm may be lowered to bring golf balls 120 close to platforms 108. After golf balls 120 have been brought close to platforms 108, the suction mechanism may be turned off to reduce the negative pressure holding golf balls 120 against cups 604 of holding units 602. Golf balls 120 may then be deposited onto magnetic levitation platforms 108 where the magnetic material interacts with the generated magnetic field to cause golf balls 120 to levitate.

In a third stage 630, uncoated golf balls 120 have been deposited onto magnetic levitation platforms 108. After golf balls 120 have been placed onto platforms 108, the arm of apparatus 600 may lifted up and away from carrier 106 of conveyor apparatus 102. In some embodiments, carrier 106 may begin moving after golf balls 120 have been introduced into coating system 100 by apparatus 600. In an exemplary embodiment, carrier 106 may be configured to move at a speed that will keep golf balls 120 from moving off platforms 108. In the embodiment illustrated in FIG. 6, apparatus 600 is shown holding three golf balls for introduction into coating system 100. It should be understood that apparatus 600 may be configured to hold more or less golf balls for introduction into coating system 100. In addition, in some embodiments, carrier 106 may begin to move once apparatus 600 has deposited one or more golf balls onto respective magnetic levitation platforms. In other embodiments, however, carrier 106 may be moving when apparatus 600 is depositing golf balls onto the magnetic levitation platforms. In this case, apparatus 600 may be configured to move along with carrier 106 and to approximately match the speed of carrier 106 when depositing golf balls onto the magnetic levitation platforms.

Figure 7:
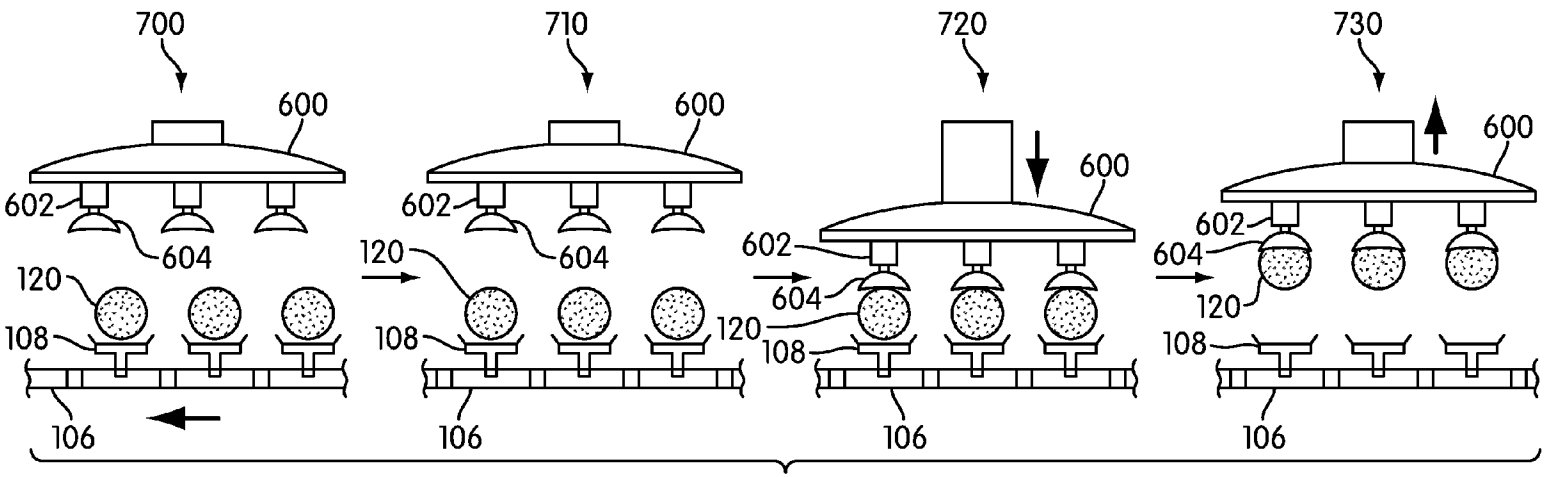
FIG. 7 is a schematic view of an exemplary embodiment of an apparatus for removing golf balls from a coating system.

Referring now to FIG. 7, an exemplary embodiment of an apparatus for removing golf balls from coating system 100 is illustrated. In some embodiments, the apparatus for removing golf balls from coating system 100 may be substantially similar to apparatus 600, described above. In an exemplary embodiment, the same apparatus 600 may be used to introduce uncoated golf balls into coating system 100 and also to remove coated golf balls from coating system 100. In other embodiments, a different apparatus than apparatus 600 may be used for removing golf balls from coating system 100.

The removal of golf balls from coating system 100 using apparatus 600 may be described with reference to FIG. 7. In this embodiment, apparatus 600 includes holding units 602 and cups 604, described above. Similarly, in this embodiment, apparatus 600 includes a suction mechanism (not shown), as described above, that generates negative pressure allowing holding units 602 to hold golf ball 120. In a first stage 700, a plurality of coated golf balls 120 have been processed through one or more spraying stations where one or more layers of coating material have been applied. Golf balls 120 levitating on magnetic levitation platforms 108 are transported along conveyor apparatus 102 on carrier 106. In an exemplary embodiment, the one or more layers of coating material on golf balls 120 are allowed to sufficiently dry prior to removal from coating system 100. In some cases, golf balls 120 may be allowed to remain on conveyor apparatus 102 for a period of time sufficient to allow the one or more layers of coating material to dry. In other cases, golf balls 120 may be transported along conveyor apparatus 102 through one or more drying or curing stations that are configured to dry the one or more layers of coating material.

Once golf balls 120 are sufficiently dry to be removed from the coating system 100, apparatus 600 may be used. In a second stage 710, apparatus 600 may be positioned over coated golf balls 120. Each holding unit 620 may be aligned over a respective golf ball 120 levitating on magnetic levitation platform 108 on carrier 106. In a third stage 720, once apparatus 600 has aligned holding units 602 with magnetic levitation platforms 108, the arm may be lowered close to golf balls 120 on platforms 108. After holding units 602 have been brought close to golf balls 120, the suction mechanism may be turned on to increase the negative pressure to hold golf balls 120 against cups 604 of holding units 602. In a fourth stage 730, the arm of apparatus 600 may be raised, lifting golf balls 120 off of magnetic levitation platforms 108 on carrier 106. After fourth stage 730, coated golf balls 120 may then be removed from coating system 100.

In some embodiments, carrier 106 may stop moving when golf balls 120 reach apparatus 600. In other embodiments, carrier 106 may remain moving when apparatus 600 is removing golf balls from the magnetic levitation platforms. In this case, apparatus 600 may be configured to move along with carrier 106 and to approximately match the speed of carrier 106 when removing golf balls from the magnetic levitation platforms. In the embodiment illustrated in FIG. 7, apparatus 600 is shown holding three golf balls for removal from coating system 100. It should be understood that apparatus 600 may be configured to hold more or less golf balls for removal from coating system 100.

FIGS. 6 and 7 illustrate an embodiment of apparatus 600 that includes a suction mechanism for holding golf balls 120 in place with holding units 602. In other embodiments, apparatus 600 may use other mechanisms for holding golf balls 120 in place for introduction into and/or removal from coating system 100. In one embodiment, apparatus 600 may use a magnet and/or magnetic field source to generate a magnetic field that is attracted to magnetic material included in golf balls 120. In this case, the magnetic field may be turned on or off to hold or drop golf balls 120 from holding units 602.

Figure 8:
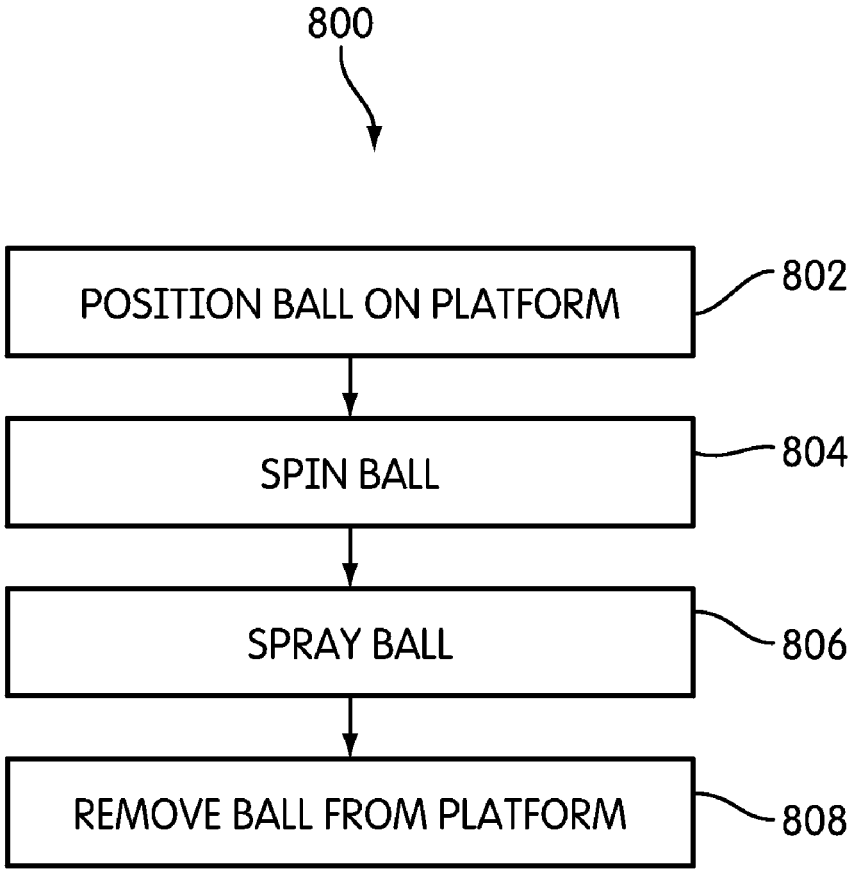
FIG. 8 is a representative view of an exemplary embodiment of a process for coating a golf ball.

Referring now to FIG. 8, an exemplary embodiment of a process 800 for coating a golf ball using magnetic levitation is illustrated. The order of the steps illustrated in FIG. 8 is exemplary and may be performed in any order. In addition, process 800 for coating a golf ball may include additional steps not illustrated. In some embodiments, a golf ball may pass through one or more spinning stations, spraying stations, curing stations, drying stations, in addition to those steps illustrated in FIG. 8. In an exemplary embodiment, one or more steps of process 800 may be performed and/or controlled using a control unit including a processor or computer. In one embodiment, control unit 110, described above, may be used to implement process 800. In other embodiments, additional or separate control units may be used to implement various steps associated with process 800.

In some embodiments, the golf ball may be transported between various stations where the steps associated with process 800 are performed. In one embodiment, the golf ball is transported within coating system using conveyor apparatus 102, described above. In an exemplary embodiment, process 800 for coating a golf ball using magnetic levitation may include a first step 802 of positioning the golf ball on the platform. In an exemplary embodiment, the platform may be a magnetic levitation platform 108, described above, and the golf ball may include magnetic material that interacts with a magnetic field generated by the platform, causing the golf ball to levitate on the platform. In some embodiments, first step 802 may be performed using apparatus 600, described above. When the golf ball has been positioned on the magnetic levitation platform at step 802, the golf ball may then move to a second step 804. At second step 802, spin or rotation is imparted to the golf ball. In one embodiment, spin may be imparted to the golf ball using one or more blower units 112, described above. In other embodiments, spin may be imparted to the golf ball by varying or reversing the polarity of the magnetic field generated by the magnetic field source associated with magnetic levitation platform 108.

After spin or rotation has been imparted to the golf ball at step 804, the golf ball may then move to one or more spraying stations for receiving coating material. At step 806, one or more spraying units may spray the golf ball with coating material. As described above, the coating material may include one or more paint layers, topcoats, and/or basecoats or primers, as well as any other coating material for spraying onto golf balls. In some embodiments, the strength of the magnetic field may be varied to change the height of the golf ball levitating on the platform prior to and/or during step 806. With this arrangement, the clearance between the bottom surface of the golf ball and the top surface of the platform may be made sufficient for spraying the coating material onto the golf ball, as described above. In addition, the spinning or rotation of the golf ball at step 804 may also assist with providing an even or uniform coating on the golf ball when sprayed with coating material at step 806.

Finally, after the golf balls have passed through one or more spraying stations, the applied one or more layers of coating material are allowed to sufficiently dry prior to removal from coating system 100. In some cases, the golf balls may be allowed to remain on conveyor apparatus 102 for a period of time sufficient to allow the one or more layers of coating material to dry. In other cases, the golf balls may be transported along conveyor apparatus 102 through one or more drying or curing stations that are configured to dry the one or more layers of coating material. Once the one or more layers of coating material are sufficiently dry, the coated golf balls may be removed from the magnetic levitation platforms at a fourth step 808. In some embodiments, fourth step 808 may be performed using apparatus 600, described above.

FIGS. 9 through 13 illustrate various different exemplary embodiments of golf balls containing magnetic material. Magnetic materials may be selected from a group of materials that interact with a magnetic field, including, but not limited to: iron, steel, nickel, cobalt, associated alloys, and any other ferromagnetic materials. In response to a magnetic field, the magnetic material may be repulsed. Using this property, a golf ball containing magnetic material may be made to levitate. Similarly, the reverse effect is possible, where a magnetic field may be configured to attract the magnetic material.

Generally, golf balls may be made in various configurations and may be composed of a variety of materials. Golf balls configurations may include, but are not limited to two-piece, three-piece, or four-piece configurations. Each configuration includes a cover. In some cases, the cover material may include, but is not limited to urethane, balata, synthetic balata, ionomer, elastomer, and other materials. The inner composition of a golf ball may include a core, a mantle, and additional core or mantle layers, depending on whether the golf ball is a two-piece, three-piece, or four-piece configuration. The inner composition of a golf ball may include a variety of materials including, but not limited to: natural rubber, balata, synthetic rubber, plastics, thermoplastics, polymers, elastomers, resins, and other materials and combinations of materials.

In various embodiments, the magnetic material may be disposed at different locations within a golf ball. In some embodiments, the magnetic material may be a layer of the golf ball. In other embodiments, the magnetic material may be a film. In still other embodiments, the magnetic material may be solid material incorporated into the golf ball.

Figure 9:
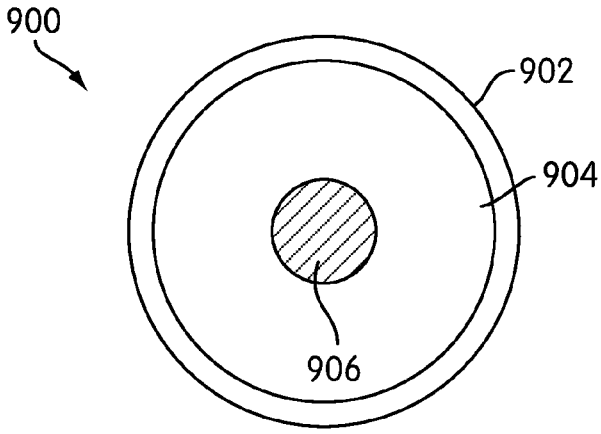
FIG. 9 is a cross-sectional view of an exemplary embodiment of a golf ball with a magnetic core.

Referring now to FIG. 9, in a first exemplary embodiment, a golf ball 900 may comprise a three-piece configuration including a cover 902, a mantle 904, and a core 906. In this embodiment, core 906 comprises a magnetic material. In various embodiments, core 906 may be a sufficient amount of magnetic material so that golf ball 900 may levitate on the platform when a magnetic field is generated. In an exemplary embodiment, core 906 may have a diameter from 4 mm to 12 mm. In one embodiment, core 906 may have a diameter less than 4 mm. In different embodiments, mantle 904 and/or cover 902 may comprise various natural and synthetic materials conventionally used for golf ball composition.

Figure 10:
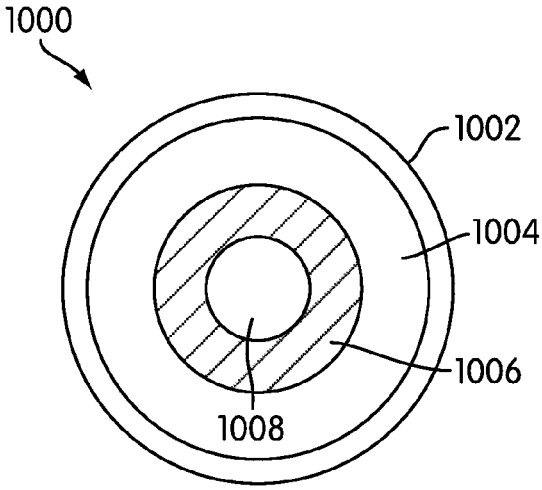
FIG. 10 is a cross-sectional view of an exemplary embodiment of a golf ball with a magnetic outer core.

Referring to FIG. 10, in a second exemplary embodiment, a golf ball 1000 may comprise a four-piece configuration including a cover 1002, a mantle layer 1004, an outer core 1006, and an inner core 1008. In this embodiment, outer core 1006 may comprise a magnetic material. In various embodiments, outer core 1006 may be a sufficient amount of magnetic material so that golf ball 1000 may levitate on the platform when a magnetic field is generated. In an exemplary embodiment, outer core 1006 may have a thickness from 1 mm to 5 mm. In one embodiment, outer core 1006 may have a thickness less than 1 mm. In an exemplary embodiment, magnetic material forming outer core 1006 may be soft and thin. In one embodiment, the Shore D hardness of outer core 1006 may be from 70 to 60. In an exemplary embodiment, the Shore D hardness of outer core 1006 may be less than 60. In different embodiments, cover 1002, mantle layer 1004, and/or inner core 1008 may comprise various natural and synthetic materials conventionally used for golf ball composition.

Figure 11:
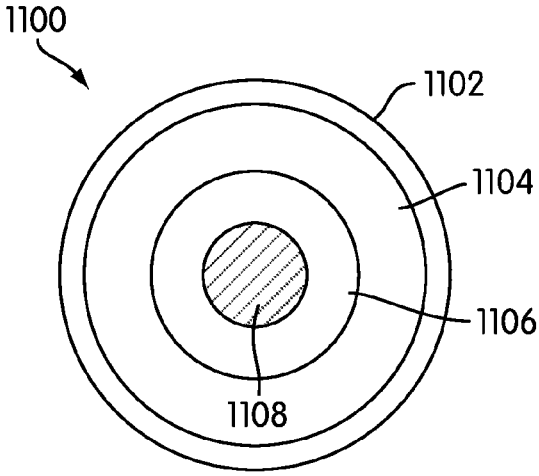
FIG. 11 is a cross-sectional view of an exemplary embodiment of a golf ball with a magnetic inner core.

Referring now to FIG. 11, in a fourth exemplary embodiment, a golf ball 1100 may comprise a four-piece configuration including a cover 1102, a mantle layer 1104, an outer core 1106, and an inner core 1108. In this embodiment, inner core 1108 may comprise a magnetic material. In various embodiments, inner core 1108 may be a sufficient amount of magnetic material so that golf ball 1100 may levitate on the platform when a magnetic field is generated. In an exemplary embodiment, inner core 1108 may have a diameter from 4 mm to 12 mm. In one embodiment, inner core 1108 may have a diameter less than 4 mm. In different embodiments, cover 1102, mantle layer 1104, and/or outer core 1006 may comprise various natural and synthetic materials conventionally used for golf ball composition.

Figure 12:
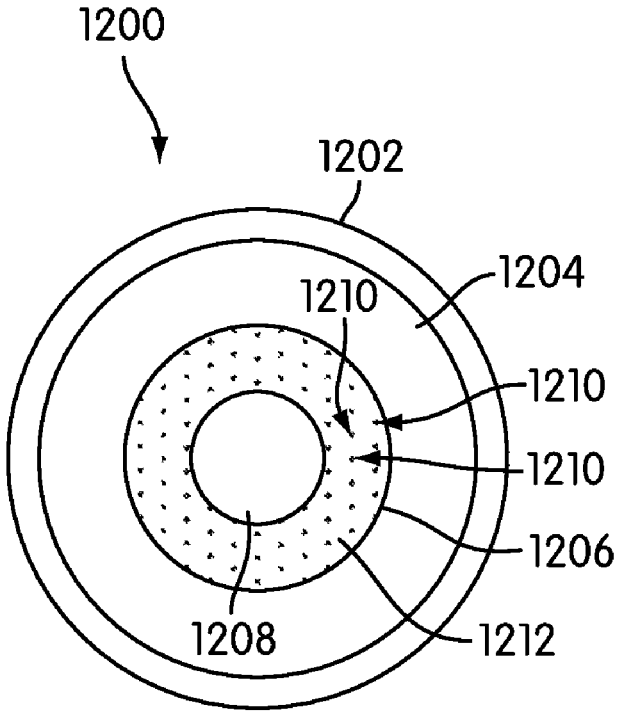
FIG. 12 is a cross-sectional view of an exemplary embodiment of a golf ball with a layer containing magnetic material.

In some embodiments, a golf ball may include magnetic material disposed within a layer with one or more other materials. Referring now to FIG. 12, in a fifth exemplary embodiment, a golf ball 1200 may comprise a four-piece configuration including a cover 1202, a mantle layer 1204, an outer core 1206, and an inner core 1208. In this embodiment, outer core 1206 may comprise a portion of magnetic material 1210 and a portion of non-magnetic material 1212. In one embodiment, magnetic material 1210 may be substantially evenly dispersed throughout non-magnetic material 1212 to form outer core 1206. With this arrangement, the mass of magnetic material 1210 within golf ball 1200 may be substantially balanced to prevent any change in the performance characteristics of golf ball 1200. In different embodiments, cover 1202, mantle layer 1204, and/or inner core 1208, as well as non-magnetic material 1212, may comprise various natural and synthetic materials conventionally used for golf ball composition.

Figure 13:
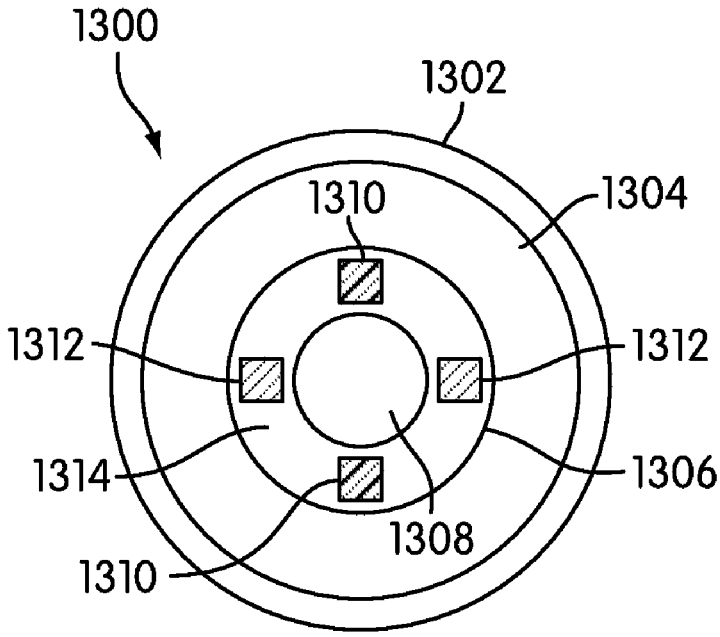
FIG. 13 is a cross-sectional view of an exemplary embodiment of a golf ball with a layer containing an asymmetric arrangement of magnetic material.

In some embodiments, magnetic material may be arranged within a golf ball in a magnetically asymmetric manner. Referring now to FIG. 13, in a sixth exemplary embodiment, a golf ball 1300 may comprise a four-piece configuration including a cover 1302, a mantle layer 1304, an outer core 1306, and an inner core 1308. In this embodiment, outer core 1306 may comprise magnetic material 1312 arranged in a magnetically asymmetric manner within a non-magnetic material 1314. As shown in FIG. 13, outer core 1306 may include magnetic material 1312 disposed only on opposite sides of golf ball 1300. With this arrangement, portions of outer core 1306 that are not associated with magnetic material 1312 may cause golf ball 1300 to have a weaker interaction with a magnetic field when those areas are closer to the magnetic field source. In different embodiments, cover 1302, mantle layer 1304, and/or inner core 1308, as well as non-magnetic material 1314, may comprise various natural and synthetic materials conventionally used for golf ball composition.

In some embodiments, the asymmetric arrangement of magnetic material 1312 within golf ball 1300 may be used to assist with spinning of the golf ball on a magnetic levitation platform. With this arrangement, the strength of the interaction between magnetic material 1312 within the golf ball and the generated magnetic field may vary based on the position of the golf ball on the platform, causing the golf ball to rotate as the magnetic field alternates in strength.

In some embodiments, a portion of outer core 1306 may include a balancing non-magnetic material 1310. In one embodiment, balancing non-magnetic material 1310 may be a material that has approximately the same mass as magnetic material 1312 and that does not interact with a magnetic field. In an exemplary embodiment, balancing non-magnetic material 1310 may be arranged within outer core 1306 so as to balance or counteract the mass of magnetic material 1312. With this arrangement, the mass of different materials may be substantially evenly balanced throughout outer core 1306 to prevent any change in the performance characteristics of golf ball 1300.

In addition to the exemplary embodiments described in FIGS. 9 through 13, in other embodiments, magnetic material may be included in any one or more portions and/or layers of a golf ball.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball coating system comprising:
a conveyor apparatus including a drive system and a carrier, wherein the drive system is configured to provide movement to the carrier;
a platform associated with the carrier, the carrier moving the platform through the golf ball coating system;
the platform further comprising a base portion that includes a magnetic field source;
a spraying unit for spraying a coating material onto the golf ball; and
wherein the magnetic field source included in the base portion of the platform generates a magnetic field that interacts with magnetic material disposed within the golf ball to levitate the golf ball above the base portion of the platform.

2. The system according to claim 1, wherein the strength of the magnetic field is varied to change a height of the golf ball above the base portion of the platform.

3. The system according to claim 2, wherein the strength of the magnetic field may be controlled so that the height is set to a selected height within a range from 1 cm to 10 cm.

4. The system according to claim 1, further comprising a spinning station for imparting a rotation to the golf ball levitating above the base portion of the platform.

5. The system according to claim 4, wherein the spinning station includes at least one blower unit.

6. The system according to claim 5, wherein the blower unit includes an air nozzle configured to channel air towards an outer periphery of the golf ball.

7. The system according to claim 4, wherein the spinning station is located before the spraying unit along the conveyor apparatus.

8. A golf ball coating system comprising:
at least one golf ball containing magnetic material;
a conveyor apparatus including a drive system for transporting a carrier, the carrier including at least one platform that moves through the golf ball coating system with the carrier;
the platform having a base portion that includes a magnetic field source for generating a magnetic field, wherein the at least one golf ball moves through the golf ball coating system with the platform;
a spraying unit for spraying a coating material onto the at least one golf ball; and
wherein the at least one golf ball containing magnetic material levitates above the base portion of the platform when the magnetic field source is generating the magnetic field.

9. The system according to claim 8, wherein the at least one golf ball comprises a layer of magnetic material.

10. The system according to claim 9, wherein the layer of magnetic material is less than 4 mm in diameter when disposed in a core and less than 4 mm in thickness when disposed in an outer core or mantle layer.

11. The system according to claim 8, further comprising at least two spraying units for spraying the coating material onto the at least one golf ball.

12. The system according to claim 8, further comprising a blower unit configured to impart rotation to the at least one golf ball levitating above the base portion of the platform.

13. The system according to claim 12, wherein the at least one golf ball is rotated by the blower unit prior to being coated by the spraying unit.

14. The system according to claim 8, further comprising an apparatus including a suction mechanism for at least one of placing the at least one golf ball onto the platform and removing the at least one golf ball from the platform.

15. The system according to claim 1, wherein the platform includes a lip disposed along a perimeter of the platform.

16. The system according to claim 15, wherein a top surface of the base portion of the platform includes one or more layers of a removable film.

17. The system according to claim 1, wherein the carrier includes at least one of a belt or chain.

18. The system according to claim 8, wherein the carrier includes a plurality of platforms, each platform of the plurality of platforms having a base portion including a magnetic field source;
wherein the at least one golf ball includes a plurality of golf balls containing magnetic material; and
wherein each golf ball of the plurality of golf balls levitates above the base portion of one of the plurality of platforms when the magnetic field source is generating the magnetic field.

19. The system according to claim 11, wherein the at least two spraying units are oriented at different angles relative to the platform.

20. The system according to claim 12, wherein the at least one golf ball includes dimples disposed on an outer surface of the at least one golf ball; and wherein air from the blower unit is configured to interact with the dimples to generate friction that causes the at least one golf ball to rotate while it levitates above the base portion of the platform.

* * * * *